US008240872B1

(12) United States Patent
Horn

(10) Patent No.: US 8,240,872 B1
(45) Date of Patent: Aug. 14, 2012

(54) SECURITY SAFE INTERIOR LIGHTING SYSTEM

(75) Inventor: William A. Horn, Chino Hills, CA (US)

(73) Assignee: Cannon Safe Inc., San Bernardino, CA (US)

( * ) Notice: Subject to any disclaimer, the term of this patent is extended or adjusted under 35 U.S.C. 154(b) by 452 days.

(21) Appl. No.: 12/321,154

(22) Filed: Jan. 21, 2009

Related U.S. Application Data

(60) Provisional application No. 61/062,763, filed on Jan. 29, 2008.

(51) Int. Cl.
*F21V 33/00* (2006.01)

(52) U.S. Cl. ..... 362/155; 362/800; 362/154; 362/156; 362/802

(58) Field of Classification Search ..... 362/155, 362/800, 154, 156, 802
See application file for complete search history.

(56) References Cited

U.S. PATENT DOCUMENTS

| | | | | |
|---|---|---|---|---|
| 2,246,676 | A * | 6/1941 | Hainsworth | 62/264 |
| 5,032,957 | A * | 7/1991 | Canfield | 362/133 |
| 5,180,222 | A * | 1/1993 | Robinson | 362/125 |
| 5,580,155 | A * | 12/1996 | Hildebrand et al. | 362/133 |
| 5,909,955 | A | 6/1999 | Roorda | |
| 5,937,666 | A * | 8/1999 | Trulaske, Sr. | 62/264 |
| 5,971,515 | A * | 10/1999 | Baker et al. | 312/329 |
| 6,363,760 | B1 * | 4/2002 | Sigmond | 70/63 |
| 6,641,283 | B1 * | 11/2003 | Bohler | 362/238 |
| 7,178,370 | B2 | 2/2007 | Engel | |
| 7,387,406 | B2 | 6/2008 | Swaris et al. | |
| 7,394,109 | B2 | 7/2008 | Lin | |
| 7,449,839 | B1 | 11/2008 | Chen | |
| 7,461,942 | B1 | 12/2008 | Kocher | |
| 7,461,944 | B2 | 12/2008 | Alessio | |
| 2006/0075698 | A1 * | 4/2006 | Alessandro | 52/202 |

* cited by examiner

*Primary Examiner* — Diane Lee
*Assistant Examiner* — Jessica M Apenteng
(74) *Attorney, Agent, or Firm* — Gordon K. Anderson

(57) ABSTRACT

An interior lighting system for a security safe is taught which incorporates a power supply that is located within the safe and converts alternating current power to low voltage direct current. An electrical switch is in communication with the power supply and mechanically interfaces with the safe door boltworks which energize the lighting system when the safe door is unlocked and opened. A number of LED lights are disposed within the door edge and connected to the switch. When the door is hinged open the LED lights are energized through the switch and illuminate the interior of the safe until the door is closed and bolted.

5 Claims, 3 Drawing Sheets

SECURITY SAFE INTERIOR LIGHTING SYSTEM

CROSS REFERENCE TO RELATED APPLICATION

This application claims priority of Provisional Patent Application Ser. No. 61/062,763 filed Jan. 29, 2008.

TECHNICAL FIELD

The present invention relates to interior lighting in general and more specifically to an interior lighting system, utilizing LED puck lights, incorporated into a security safe. The lighting system provides illumination to the interior of the structure within the safe utilizing lights mounted directly on the edge of the door.

BACKGROUND ART

Previously, many systems of lights for illumining the internal area of a security safe, vault or cabinet have been used in endeavoring to provide an effective means for visualizing items stored inside. However in most cases the systems have been limited to incandescent or fluorescent electric lights with individual or parallel lighting circuits located within the structure itself.

The prior art listed below did not disclose patents that possess any of the novelty of the instant invention; however the following U.S. patents are considered related:

| U.S. Pat. No. | Inventor | Issue Date |
|---|---|---|
| 5,909,955 | Roorda | Jun. 8, 1999 |
| 7,178,370 B2 | Engel | Feb. 20, 2007 |
| 7,387,406 B2 | Swaris et al. | Jun. 17, 2008 |
| 7,394,109 B2 | Lin | Jul. 1, 2008 |
| 7,449,839 B2 | Chen | Nov. 11, 2008 |
| 7,461,942 B1 | Kocher | Dec. 9, 2008 |
| 7,461,944 B2 | Alessio | Dec. 9, 2008 |

Roorda in U.S. Pat. No. 5,909,955 discloses a light fixture having a lamp assembly, a cylindrical housing surrounding and supporting the lamp assembly, with a mounting ring surrounding and supporting the housing. The mounting ring includes an upper edge with a plurality of circumferentially spaced projections for engaging a support surface to define a plurality or airflow gaps. The mounting ring also has a pair of radially inwardly directed mounting tabs extending from the upper edge of the mounting ring for receiving fastener screws.

U.S. Pat. No. 7,178,370 B2 issued to Engel is for a biometric self-contained gravity-operated illuminated tactile gun safe which includes a computer system for use by a home owner under the darkness of night. The gun safe permits a loaded ready to use firearm to be stored within and accessed safely and quickly. The safe door opens silently and uses motive power provided by gravity. The safe door opens only when the safe correlates biometric data of an individual with data stored in its memory. A battery provides power for a light, which is mounted in the upper interior portion of the safe, and auxiliary power to operate the microprocessor when required.

Swaris et al. in U.S. Pat. No. 7,387,406 B2 discloses a modular light emitting diode (LED) mounting configuration which includes a light source module having at least one LED. The module includes a heat conductive body portion adapted to conduct heat generated away from the LED. As a result the LED may be operated with a higher current than normally allowed. Brightness and performance may be increased without degrading life expectancy. An adhesive connects the LED module to the mounting surface.

Lin in U.S. Pat. No. 7,394,109 B2 teaches and LED lighting device having a seat with a conductor. A light emitting diode is disposed on the conductor of the seat and has and has an upper positive pad, a lower negative conductive pad and an insulated pad there between. An exterior enclosure is disposed on top of the seat in such a manner that the bottom end of the exterior enclosure is in contact with the upper positive conductive pad.

U.S. Pat. No. 7,449,839 B2 issued to Chen teaches a LED lighting chain which includes a front plug, a rear plug, an AC-DC converter formed of four rectifying diodes and a LED serial set. The serial set has a voltage dropping device formed of resistance and two capacitors so arranged that changing the relative resistance and capacitors changes the voltage of the LED serial set. Increasing the number of LEDs does not change the brightness of the set.

U.S. Pat. No. 7,461,944 B2 of Alessio is for a lighting device using multiple LEDs to illuminate a target area. The lighting device includes a first and second light emitting diode spaced apart from each other. A first convex magnifier lens is arranged in a light path of the first LED for focusing light onto a target area. A second convex magnifier lens is arranged in a light path of the second LED for focusing light onto the same target area. The lenses are supported relative to the LEDs with a cover.

For background purposes and as indicative of the art to which the invention is related reference may be made to the remaining cited patent issued to Kocher in U.S. Pat. No. 7,461,942 B1.

DISCLOSURE OF THE INVENTION

One of the problems with a security safe is that when the door is opened there may not be enough light to see the contents within, particularly when the ambient lighting is from the ceiling or at least from a source substantially above the safe. As the safe may have individual compartments that extend the entire depth of the enclosure, items stored in the back portions may not be completely visualize, consequently there has been a long felt need to overcome this difficulty.

It is therefore the primary object of the invention to provide a lighting system that illuminates the interior from top to bottom with lights that have sufficient intensity to observe the entire contents without interference with distracting shadows.

An important object of the invention is in the use Of a type of light which must provide sufficient light energy and directional abilities to accomplish the purpose at hand. Light Emitting Diode (LED) lights are ideal for the application as they are small and compact with individual direction in each fixture. The preeminent feature of this type of light is the minimal heat dissipated when energized which permits the lights to be mounted inside an enclosed area without undue temperature rise if a light switch were mounted inside, or the light had an individual switch which could be inadvertently left on when the door is closed. With incandescent lights considerable heat is created. For example; four 25 watt lamps emit 341 btu/hr which could equate to a temperature rise of almost a one degree F. per hour in a closed dead air space, such as the inside area of a door safe. The use of LED lights using low voltage direct current could produce the same brightness at 5 watts each as LED's may produce 20-65 lumens of light at 20 mA where incandescent lamps normally produce 15 lumens of light per watt.

Another object of the invention is realized using LED lights as the life expectancy of a typical LED is from 35,000 hours to 50,000 hours whereas life of an incandescent light in a small restricted enclosure is extremely limited and is dependent upon the temperature in which it is subjected to which is depending upon air circulation to displace the heat produced.

Still another object of the invention is that the lighting system is completely automatic. When the safe door is opened a snap acting lever switch activates the LED lights in the side of the door and, as the door is opened at 90 degrees, the lights shine directly into the entire safe interior. The use of an automatic system precludes the possibility of leaving the lights on with the door closed.

To achieve the optimum light distribution to the safes interior it is anticipated that three LED puck lights would be used on a 60 inch tall safe and four on a 72 inch tall safe which permits the entire interior to be illuminated concurrently.

Yet another advantage of the invention is that the LED driver, or power supply for the lights is situated in a convenient location inside the safe which has a large volume and is easily accessed for replacement, if the need arises. Further the heat dissipated by the LED driver, or power supply, even when not in use, is useful since the heat slightly elevates the temperature inside the safe over a long period of time preventing vapor condensation within the safe and is not deleterious to the items stored therein.

A final object of the invention is the use of standard off-the-shelf components that are readily available and are subject to costs that are based on economies of number, further when the mounting holes are provided at the time of manufacture the expense is minimal making the entire lighting system particularly cost effective.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figures 1, 2:
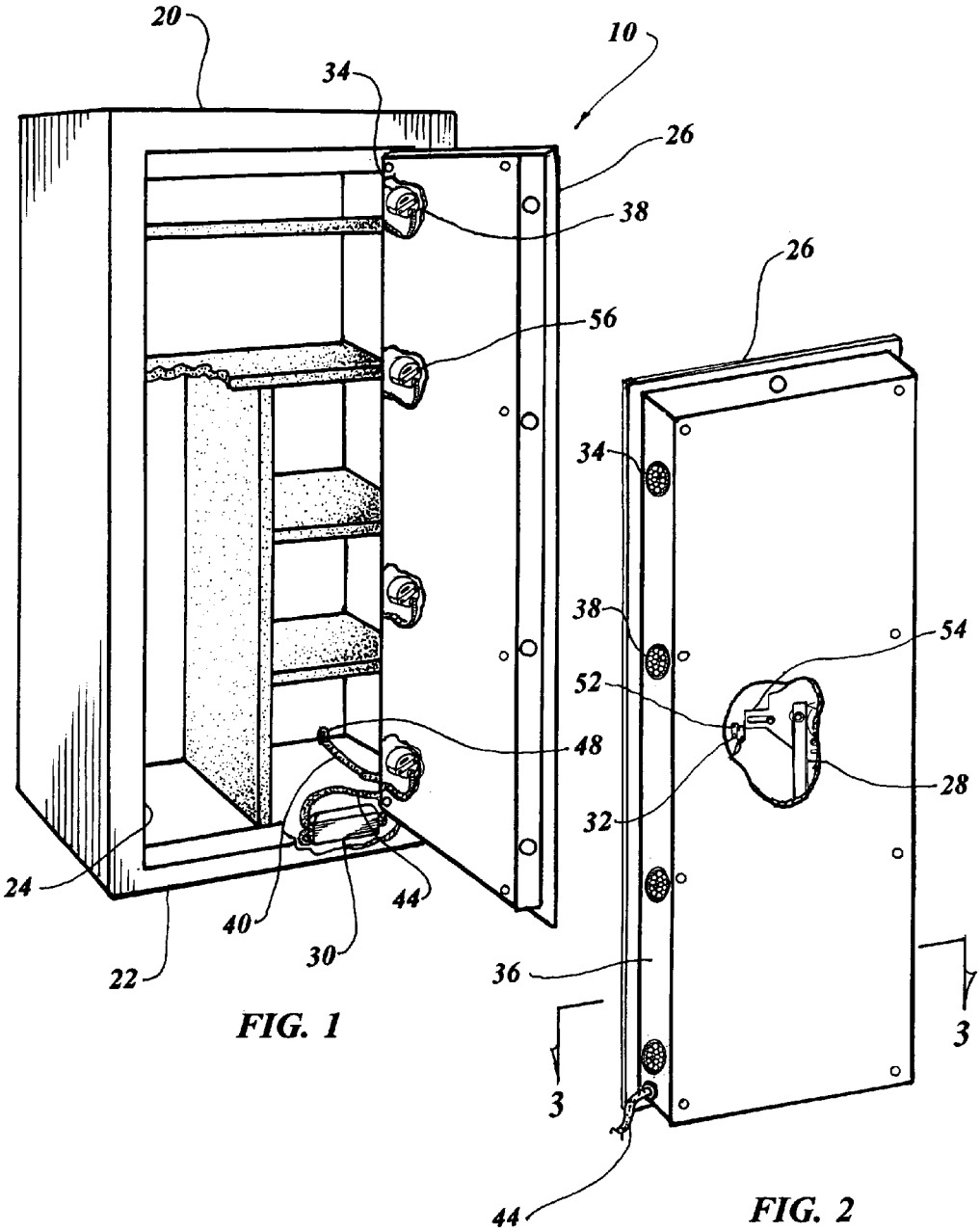
FIG. 1 is a partial isometric view, with cutaways, of a typical security safe with the door open incorporating the lighting system in the preferred embodiment.
FIG. 2 is a partial isometric view of a typical security safe door removed from the safe for clarity and further cutaway to illustrate the internal switch actuating mechanism of the lighting system.

The best mode for carrying out the invention is presented in terms of a preferred embodiment. This preferred embodiment of an interior lighting system 10 for a security safe is shown in FIGS. 1 thorough 9. The system 10 is includes a security safe 20 having an enclosure 22, a door opening 24 in the enclosure, a hinged door 26 and boltworks 28 to secure the door. The safe 20 is modified to incorporate mounting provisions for a power supply 30, mounting fasteners for attaching a switch 32 and a number of mounting holes 34 in the door edge 36 adjacent to the door opening 24 for installing lights 38.

The power supply 30, is located, within the safe enclosure 22, as illustrated in the cutaway of FIG. 1. This power supply 30 converts alternating current, from conventional mains alternating current power to a low voltage direct current for energizing the lights 38.

Figure 4:
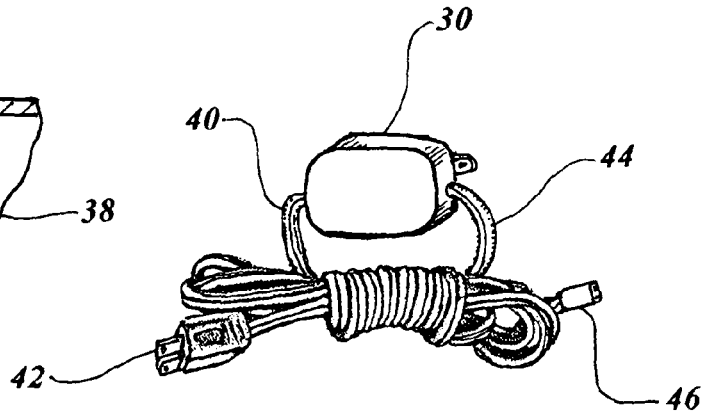
FIG. 4 is a partial isometric view of the LED driver completely removed from the invention for clarity.
Figure 5:
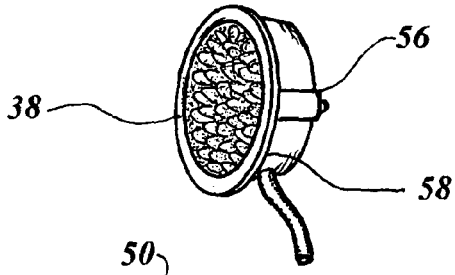
FIG. 5 is a partial isometric view of one of the LED lights completely removed from the invention for clarity.

The power supply 30, in the preferred embodiment, is specifically an LED driver (30) which includes an input power cord 40 with a plug 42 on a distal end and an output power cord 44 with a power output connection 46, or disconnect, on its distal end, as shown separately in FIG. 4. The power supply 30 is positioned near, or directly attached to the interior of the enclosure 22 with fastening means such as threaded fasteners, rivets, pressure sensitive tape, hook and loop tape and the like. The input power cord 40 is threaded through a rear opening 48 in the enclosure provided by the safe manufacturer as standard to permit electrical heaters etc. to be positioned inside the safe.

Figure 6:
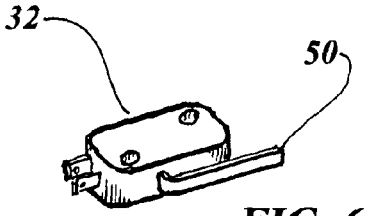
FIG. 6 is a partial isometric view of the snap acting lever switch completely removed from the invention for clarity.
Figure 7:
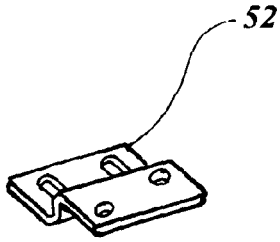
FIG. 7 is a partial isometric view of the switch bracket completely removed from the invention for clarity.

The switch 32 is in electrical communication with the power supply 30 and mechanically interfaces with the door boltworks 28, thereby energizing the lighting system 10 when the safe door 26 is unlocked and opened. The preferred embodiment of the switch 32 is the snap action lever switch type, as depicted pictorially in FIG. 6. The switch 32 has a spring loaded lever 50 that activates the internal mechanism of the switch 32 when the lever 50 is compressed.

A switch bracket 52 is attached to the switch 32, as shown in FIG. 2, and is configured to interface with the switch 32 on one offset leg and on an inside surface of the door 26 on a second leg permitting the lever 50 to contact the boltworks 28 and energize the switch 32 turning on the lights 38. FIG. 2 illustrates the lever 50 in the actuated position intimately engaging a sliding plate 54 of the boltworks 28.

Figure 8:
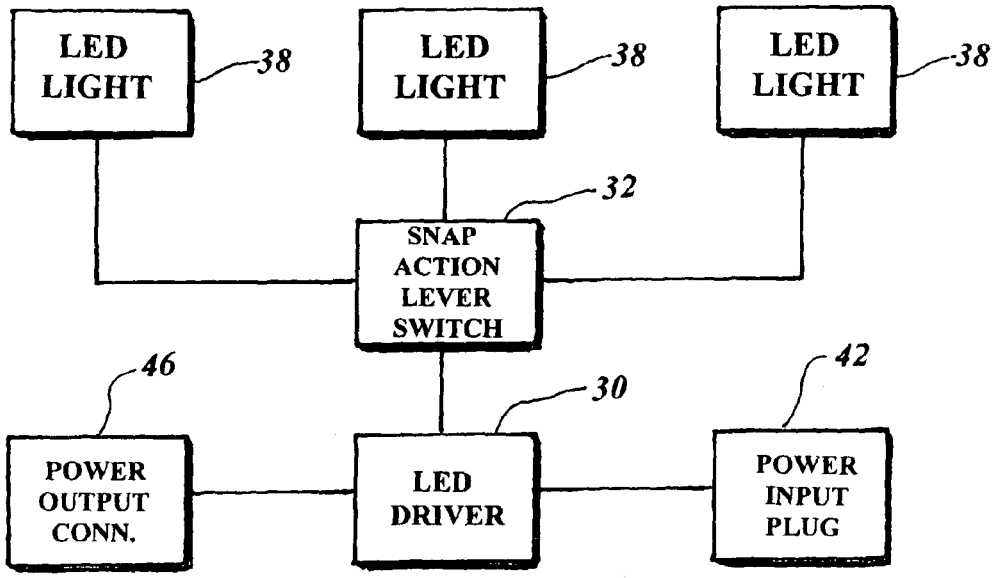
FIG. 8 is a block diagram of the electrical system.
Figure 9:
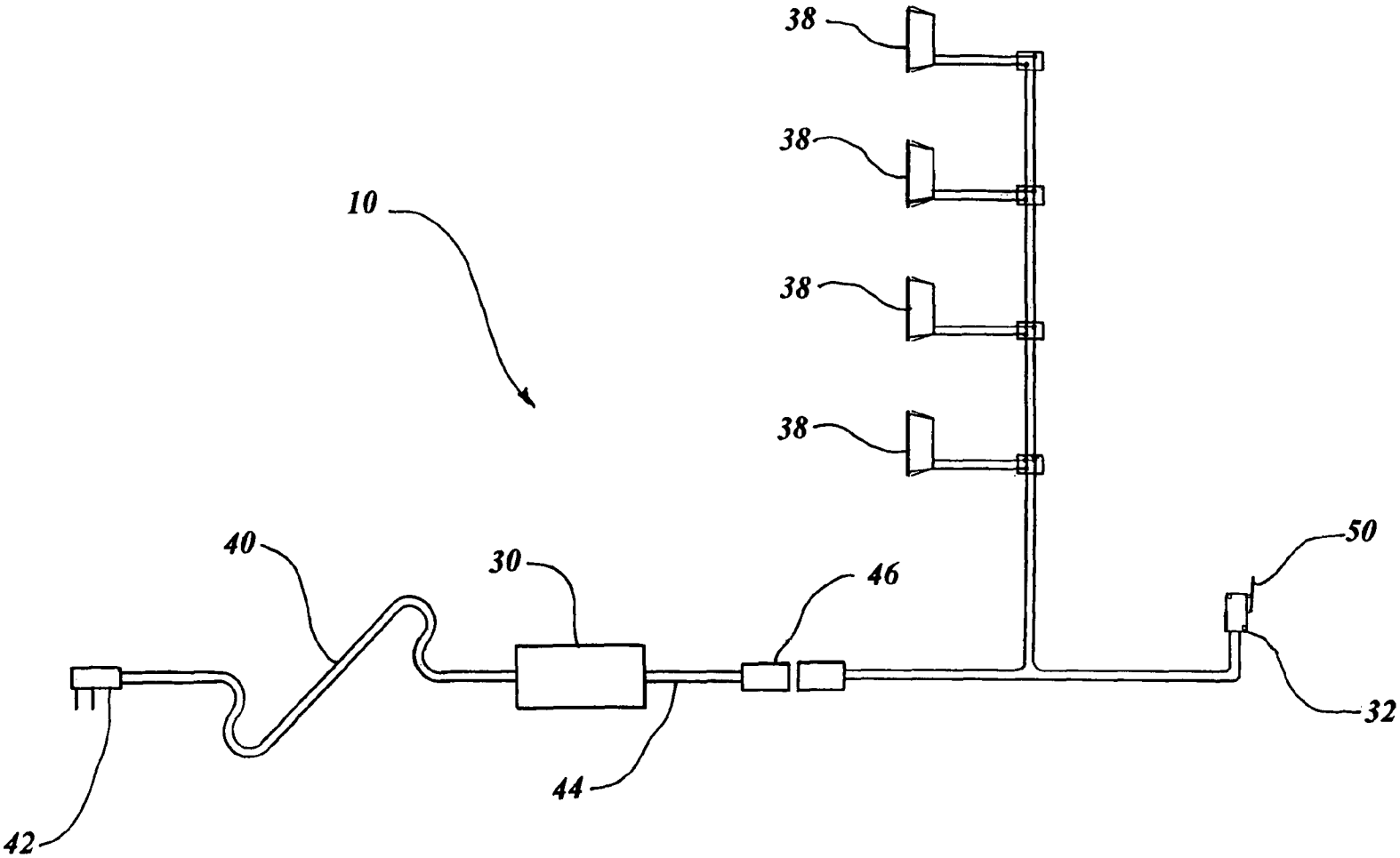
FIG. 9 is an electrical schematic of the lighting system.

The lights 38 are located in the mounting holes 34 of the door 26 adjacent to the door opening 24 and preferably consist of a plurality of LED type lights which are in electrical communication with the switch 32 as illustrated in the block diagram of FIG. 8 and schematic of FIG. 9. When the door 26 is hinged open the LED lights 38 are energized through the switch 32 and illuminate the interior of the safe 20 until the door 26 is closed and bolted.

Figure 3:
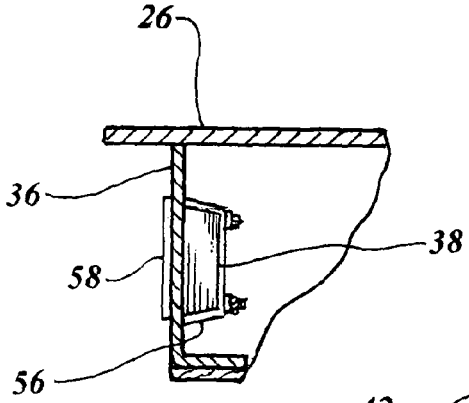
FIG. 3 is a cross sectional view taken along lines 3-3 of FIG. 2.

The preferred LED type lights 38 are the so called "puck light" style which each include a rear mounted channel shaped bracket 56 and a flanged bezel 58 permitting the lights 38 mounted through the opening in the edge of the door 26 adjacent to the door opening and secured with the channel shaped bracket 56 from the inside of the edge of the door 36, as illustrated in FIG. 3.

The preferred number of LED puck lights 38 is three each for a 60 inch tall safe and four each on a 72 inch tall safe which, through exhaustive testing, has been found that the entire interior may be illuminated concurrently. Any number of lights may be used and still achieve the same utility for security safes that have different heights and interior arrangements as well as diverse shapes.

While LED lights 38 are preferred the use of incandescent or fluorescent lights 38 still fall within the understanding of this invention with the power supply 30 eliminated with their use.

The block diagram of FIG. 8 and the schematic of FIG. 9 show the relationship of the various elements of the invention and its automatic feature since once the power supply 30 is energized the lights 38 turn on automatically each time the door 26 is opened.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

Element Designation
(For convenience of the Examiner, not part of the specification)

| | |
|---|---|
| 10 | lighting system |
| 20 | safe |
| 22 | enclosure (of 20) |
| 24 | door opening (in 22) |
| 26 | door (of 20) |
| 28 | boltworks (of 20) |
| 30 | power supply |
| 32 | switch |
| 34 | mounting holes |
| 36 | door edge |
| 38 | lights |
| 40 | input power cord (on 30) |
| 42 | plug (on 40) |
| 44 | output power cord (on 30) |
| 46 | disconnect (on 44) |
| 48 | rear opening (in 22 for 40) |
| 50 | lever (of 32) |
| 52 | switch bracket |
| 54 | sliding plate (of 28) |
| 56 | channel shaped bracket (of 38) |
| 58 | flanged bezel (of 38) |

The invention claimed is:

1. An interior lighting system for a security safe which comprises:

said security safe having an enclosure, the enclosure having a door opening and a hinged door within the opening, with the door having boltworks, defined as locking bolts, for door locking and a sliding plate, with the door having a number of mounting holes in the door edge adjacent to the door opening, a power supply located, within the safe enclosure, for converting alternating current mains power to a low voltage direct current, a snap action lever switch in electrical communication with said power supply and mechanically interfacing with the door boltworks, a switch bracket configured to interface with the switch on one offset leg and on an inside surface of the door on a second leg permitting the lever of the switch to engage the sliding plate of the boltworks for energizing the lighting system when the safe door is unlocked and opened, a plurality of LED puck lights, in electrical communication with the switch, disposed within a door edge adjacent to the door opening, such that when the door is hinged open the LED lights are energized through the switch and illuminate the interior of the safe until the door is closed and bolted, and wherein said LED puck lights having a rear mounted channel shaped bracket and a flanged bezel permitting the lights to be mounted through said mounting holes in said door edge adjacent to the door opening and secured with the bracket from inside the door.

2. The interior lighting system as recited in claim 1 wherein said power supply further comprises an LED driver having an input power cord with a plug on a distal end and an output power cord with a output connector on a distal end.

3. The interior lighting system as recited in claim 1 wherein said plurality of lights further comprise three LED puck lights.

4. The interior lighting system as recited in claim 1 wherein said plurality of lights further comprise four LED puck lights.

5. An interior lighting system for a security safe which comprises:

Said security safe having an enclosure, the enclosure having a door opening and a hinged door within the opening, with the door including boltworks, defined as locking bolts, for door locking, a power supply located, within the safe enclosure, for converting alternating current mains power to a low voltage direct current, a switch in electrical communication with said power supply and mechanically interfacing with the door boltworks, for energizing the lighting system when the safe door is unlocked and opened, a switch bracket configured to interface with the switch on an inside surface of the door permitting a lever of the switch the switch to contact the boltworks and energize the switch to activate the plurality of lights, and a plurality of LED puck lights, in electrical communication with the switch, the LED puck lights having a rear mounted channel shaped bracket and a flanged bezel permitting the lights to be mounted through a hole in an edge of the door adjacent to the door opening and secured with the bracket from inside the door, such that when the door is hinged open the LED lights are energized through the switch and illuminate the interior of the safe until the door is closed and bolted.

* * * * *